US008146918B2

(12) United States Patent
Shih et al.

(10) Patent No.: US 8,146,918 B2
(45) Date of Patent: Apr. 3, 2012

(54) PAPER SORTING APPARATUS AND ELECTRONIC DEVICE WITH PAPER SORTING APPARATUS

(75) Inventors: Chih-Kun Shih, Santa Clara, CA (US); Chen-Lu Fan, Taipei Hsien (TW); Chun-Hsien Lin, Taipei Hsien (TW)

(73) Assignee: Hon Hai Precision Industry Co., Ltd., Tu-Cheng, New Taipei (TW)

( * ) Notice: Subject to any disclaimer, the term of this patent is extended or adjusted under 35 U.S.C. 154(b) by 147 days.

(21) Appl. No.: 12/687,027

(22) Filed: Jan. 13, 2010

(65) Prior Publication Data

US 2011/0074104 A1 Mar. 31, 2011

(30) Foreign Application Priority Data

Sep. 30, 2009 (CN) ..... 2009 1 0308008

(51) Int. Cl.
*B65H 29/00* (2006.01)

(52) U.S. Cl. ..... 271/279; 271/296

(58) Field of Classification Search ..... 271/279, 271/287, 296, 298
See application file for complete search history.

(56) References Cited

U.S. PATENT DOCUMENTS 3,356,362 A * 12/1967 Mestre ..... 271/289
4,580,775 A * 4/1986 Maruyama ..... 271/293
5,855,368 A * 1/1999 Middelberg et al. ..... 271/272

FOREIGN PATENT DOCUMENTS

JP 58188266 A * 11/1983

* cited by examiner

*Primary Examiner* — Michael McCullough
(74) *Attorney, Agent, or Firm* — Altis Law Group, Inc.

(57) ABSTRACT

A paper sorting apparatus for an electronic device includes a chassis with a control module disposed therein, a paper transporting module accommodated in the chassis, and a plurality of paper trays attached to the chassis. The paper transporting module has a first end, that is pivotable, and a second end, that is attached to the control module. The control module is capable of rotating the second end about the first end and coupling the second end with one of the paper trays.

6 Claims, 7 Drawing Sheets

PAPER SORTING APPARATUS AND ELECTRONIC DEVICE WITH PAPER SORTING APPARATUS

BACKGROUND

1. Technical Field

The present disclosure relates to paper sorting apparatuses and electronic devices with paper sorting apparatuses.

2. Description of Related Art

Often printers will have many print jobs to process in a short time that may come from many different users. Thus it is helpful to have print jobs sorted for easy pick up by users. However, present multi-tray paper sorters are complicated and expensive.

BRIEF DESCRIPTION OF THE DRAWINGS

Many aspects of the embodiments can be better understood with references to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Figure 1:
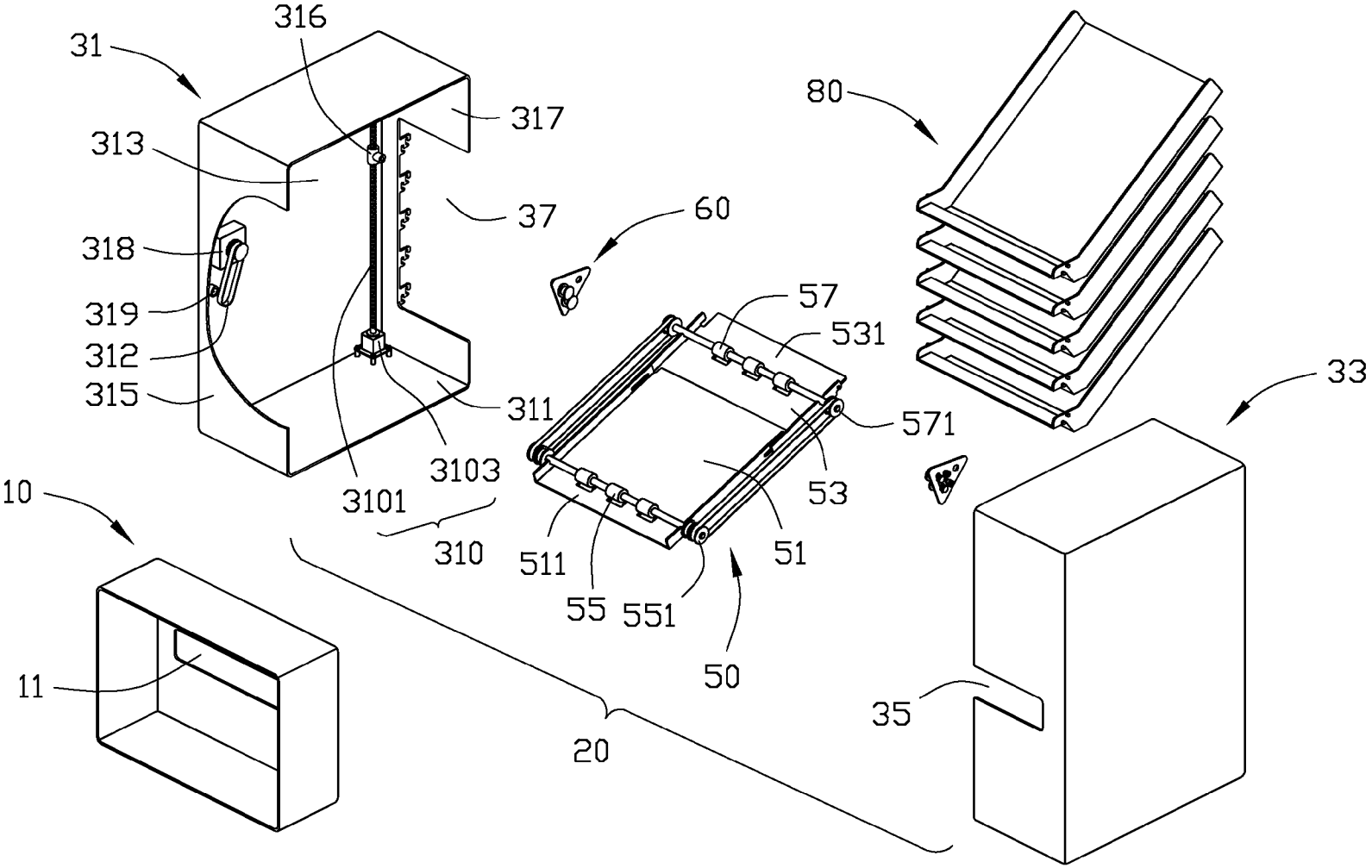
FIG. 1 is an exploded, isometric view of an electronic device with a paper sorting apparatus in accordance with an embodiment.
Figure 2:
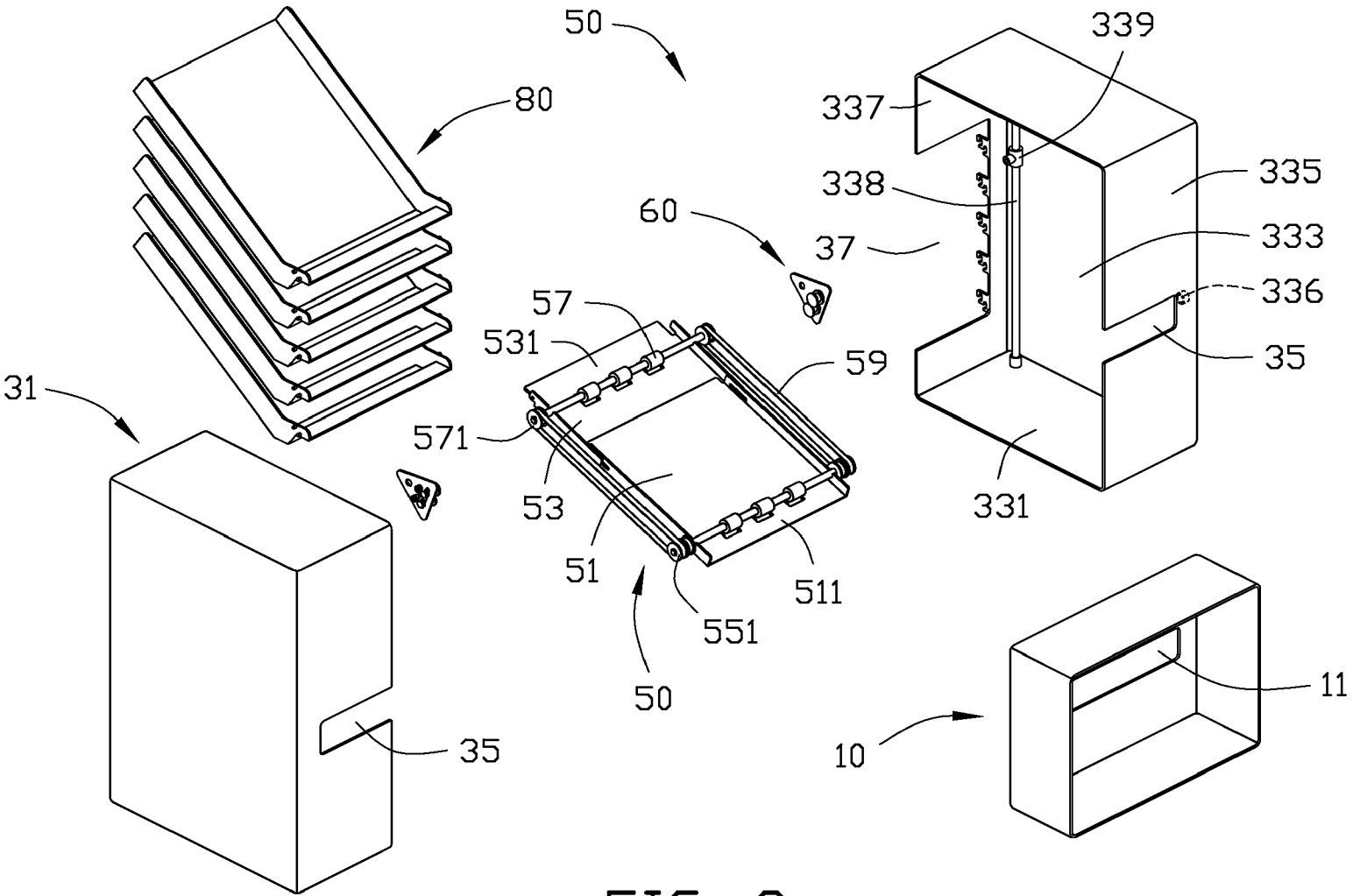
FIG. 2 is similar to FIG. 1, but viewed from another aspect.

Referring to FIGS. 1-2, an electronic device includes a main body 10 configured to print files, and a paper sorting apparatus 20 connected to the main body 10. The main body 10 defines a paper outlet 11 for paper output.

The paper sorting apparatus 20 includes a chassis 30 (labeled in FIG. 7), a paper transporting module 50, and a plurality of paper trays 80 coupled to an outside of the chassis 30. The chassis 30 includes a first part 31 and a second part 33.

The first part 31 of the chassis 30 includes a bottom wall 311, a front wall 313, and two opposite sidewalls 315, 317, which are substantially perpendicular to the bottom wall 311 and the front wall 313. A control module 310 is disposed at the bottom wall 311 adjacent to the sidewall 317. The control module 310 includes a screw shaft 3101 and a first driving device 3103. The screw shaft 3101 extends in a direction perpendicular to the bottom wall 311. A movable member, such as a nut 316, is matched with the screw shaft 3101. A second driving device 318 is secured at the front wall 313 adjacent to the sidewall 315. A first pivot member 319 is located on the front wall 313.

The second part 33 includes a bottom plate 331, a rear wall 333, and two opposite side plates 335, 337, which are substantially perpendicular to the bottom plate 331 and the rear wall 333. A guiding shaft 338 perpendicularly extends from the bottom plate 331 at a position corresponding to the screw shaft 3101. A slide member 339 is coupled to the guiding shaft 338. A second pivot member 336, corresponding to the first pivot member 319, is located on the rear plate 333. When the first part 31 and the second part 33 are connected together and form the chassis 30, the chassis 30 defines a paper inlet 35, corresponding to the paper outlet 11 in the main body 10, and an opening 37, configured to accommodate the plurality of paper trays 80.

The paper transporting module 50 includes a first transporting tray 51 and a second transporting tray 53 slidably connected to the first transporting tray 51. The first transporting tray 51 has a first end 511. A driving roller 55 is disposed on the first paper transporting tray 51 adjacent the first end 511. The driving roller 55 includes two first wheels 551 mounted at two sides of the first paper transporting tray 51. One of the first wheels 551 corresponds to the second driving device 318 and is configured to connect to the second driving device 318 via a first belt 312. When the second driving device 318 is in use, the driving roller 55 will be rotated. The second transporting tray 53 has a second end 531 adjacent the paper trays 80. A passive roller 57 is disposed on the second paper transporting tray 53 adjacent the second end 531. The passive roller 57 includes two second wheels 571 rotatable mounted at two sides of the second paper transporting tray 53. The first wheels 551 are connected to the second wheels 571 via a second belt 59. When the driving roller 55 is rotated, the passive roller 57 may be rotated by the driving roller 55.

Figure 3:
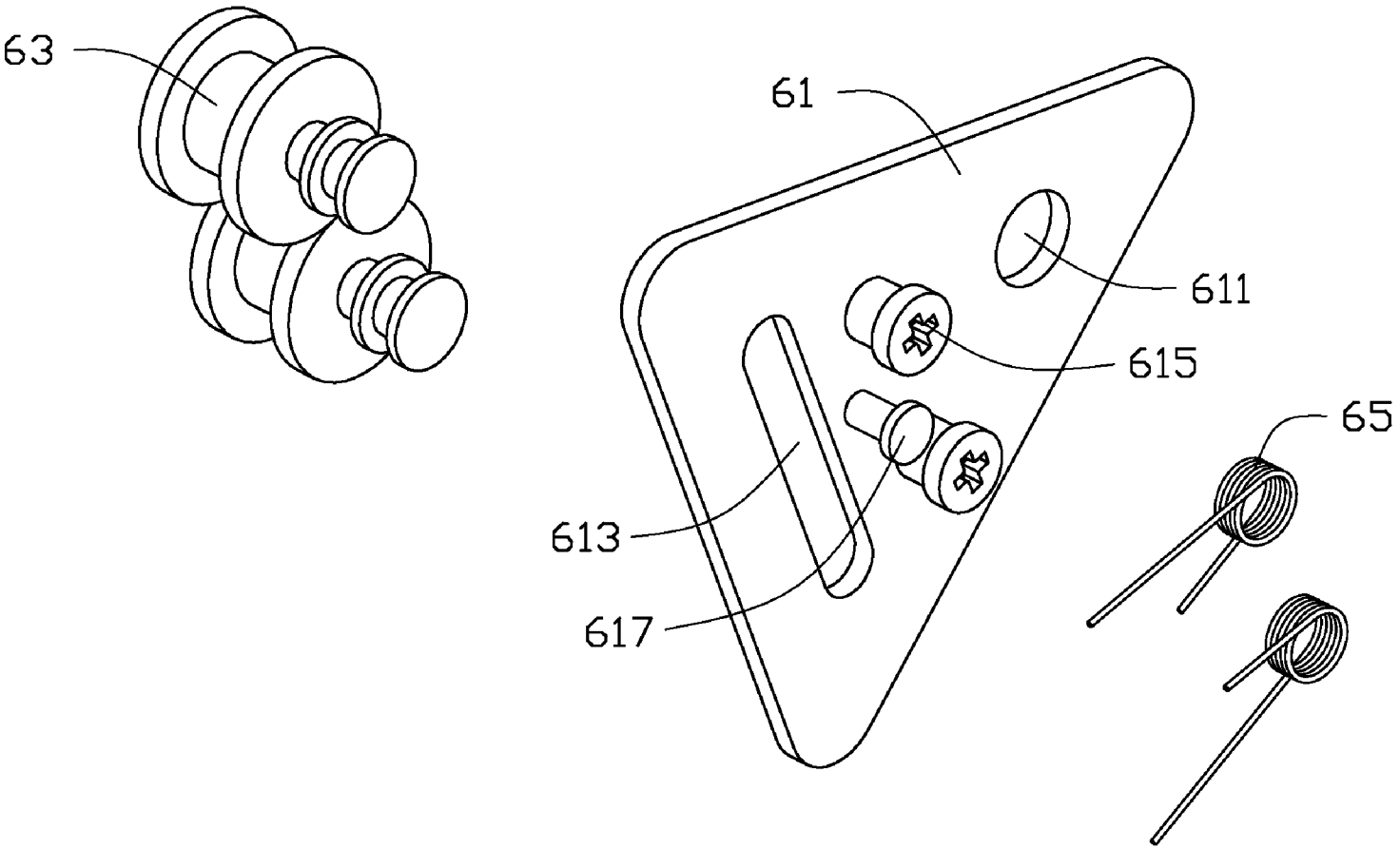
FIG. 3 is an exploded, isometric view of a belt adjusting apparatus of FIG. 1.
Figure 4:
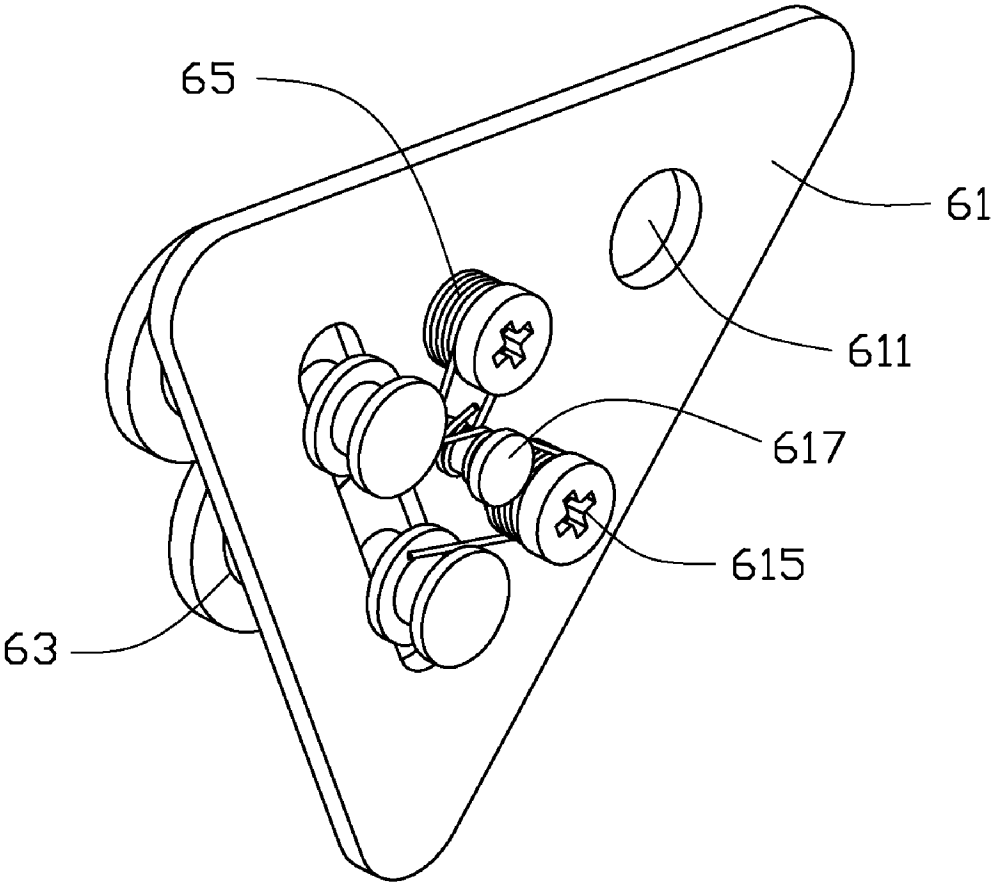
FIG. 4 is an assembled view of FIG. 3.

Referring to FIGS. 3 and 4, the paper sorting apparatus 20 further includes two belt adjusting apparatuses 60 positioned at two sides of the passive roller 57. Each of the belt adjusting apparatuses 60 includes a base 61 and two adjusting members 63. A pivot hole 611 and a longitudinal slot 613 are defined in the base 61. Two positioning members 615 and a blocking member 617 protrude from the base 61 and are located between the pivot holes 611 and the rectangular slot 613. Two spring members 65, such as two torsion springs, are arranged on the two positioning members 615. Each spring member 65 has a coil portion 651, a positioning end 653, and an actuating end 655.

Referring to FIG. 4, the adjusting members 63 extend through the slot 613, with one end blocked by the base 61. The coil portions 651 of the spring members 65 surround the positioning members 615. The positioning ends 653 of the spring members 65 are secured to the blocking member 617, and the actuating ends 655 abut against the corresponding adjusting members 63, thereby providing biasing force to move the adjusting members 63 apart.

Figure 5:
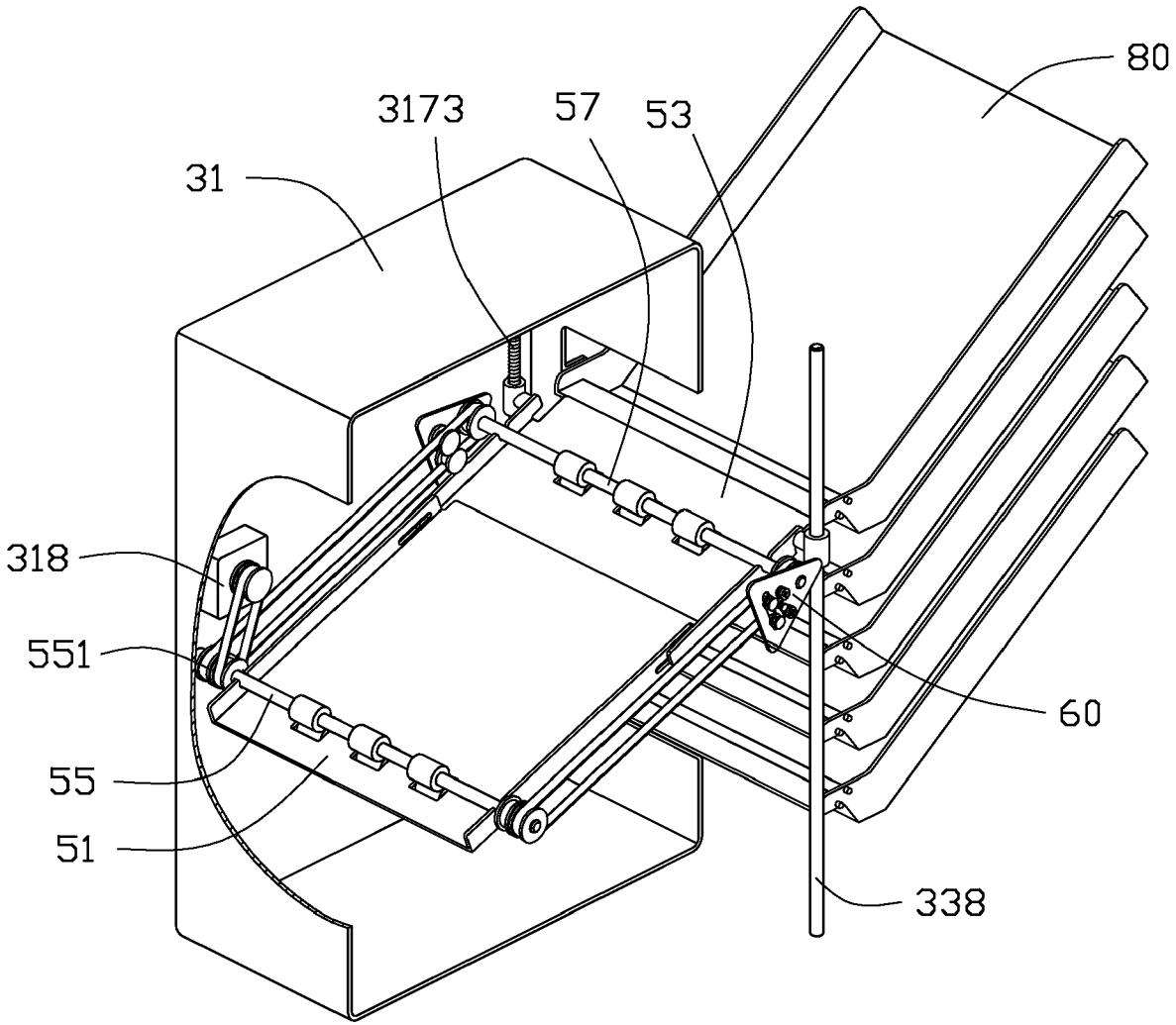
FIG. 5 is an assembled view of the paper sorting apparatus of FIG. 1.
Figure 6:
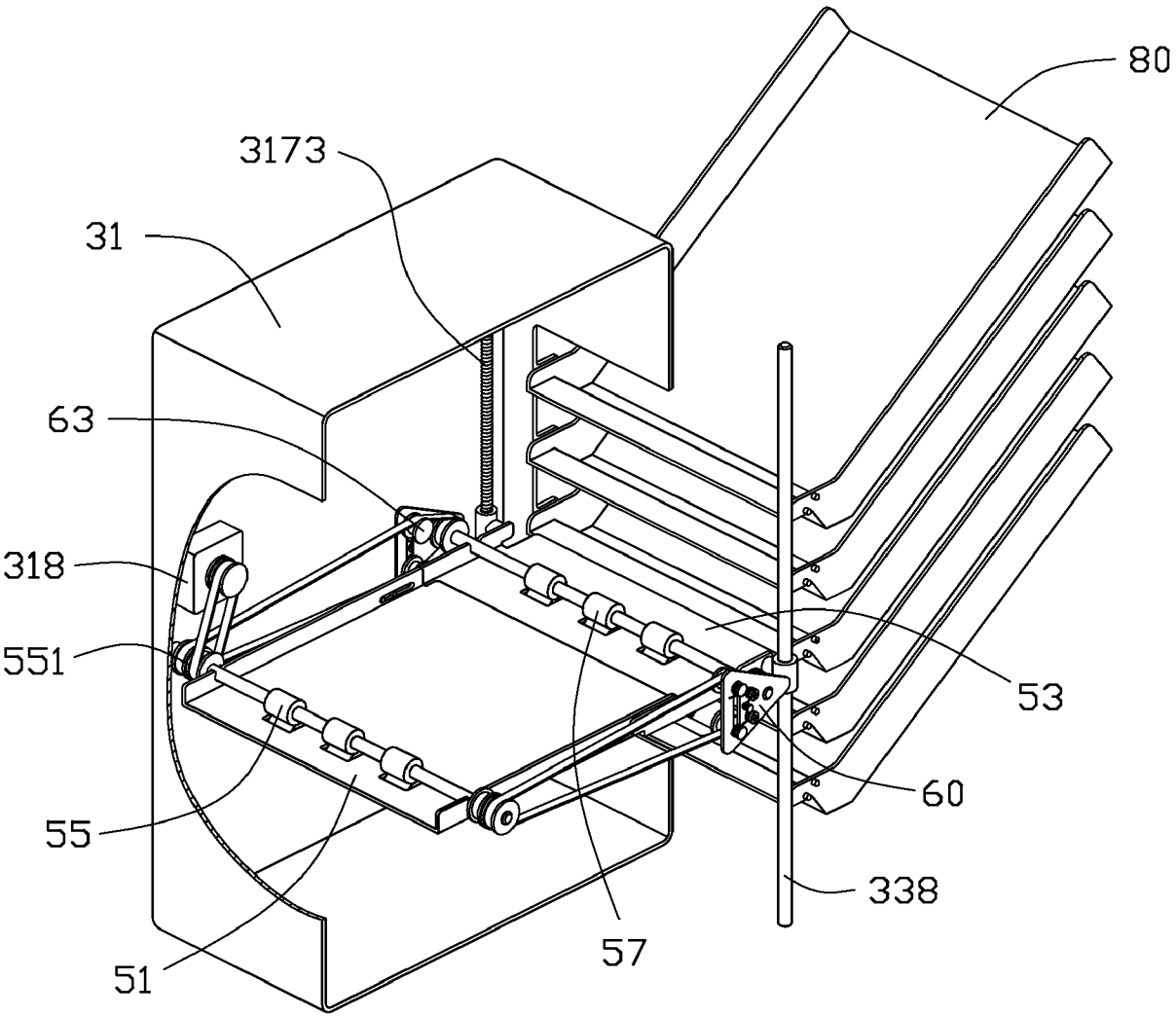
FIG. 6 is another assembled view of the paper sorting apparatus of FIG. 1.
Figure 7:
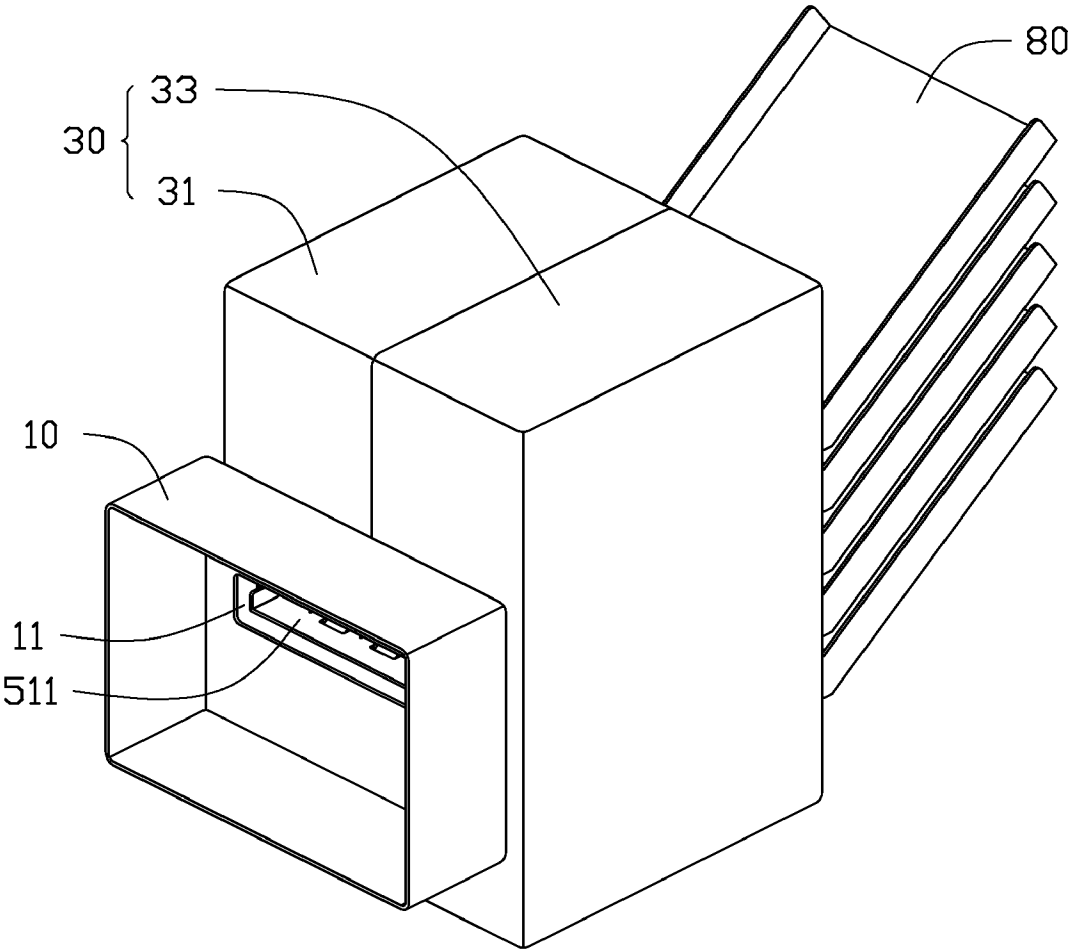
FIG. 7 is an assembled view of the electronic device of FIG. 1.

Referring to FIGS. 5 to 7, in assembly, the chassis 30 is mounted to the main body 10. The plurality of paper trays 80 are mounted to the chassis 30, with one end of each paper tray 80 accommodated in the opening 37 of the chassis 30. The paper trays 80 are aligned in a row along a direction parallel to the screw shaft 3101. The driving roller 55 of the paper transporting module 50 is pivotably attached to the first pivot member 319 and the second pivot member 336. The first wheel 551 is connected to the second driving device 318 by the belt 312. The first end 511 of the first paper transporting tray 51 is inserted into the paper outlet 11 of the main body 10 through the paper inlet 35 of the chassis 10. The passive roller 57 is pivotably attached to the nut 316 and the slide member 339. The two belt adjusting apparatuses 60 are pivotably connected to two ends of the passive roller 57. The second belts 59 lay over the corresponding adjusting members 63 of the belt adjusting apparatuses 60 to connect the first wheels 551 to the second wheels 571. The two adjusting members 63 of each belt adjusting apparatus 60 and one corresponding second wheel 571 are arranged in a triangle shape. The second end 531 is connected to one of the paper trays 80.

In use, the second driving device 318 drives the driving roller 55 to rotate about the first pivot member 319 and the second pivot member 336. The passive roller 57 is driven by the driving roller 55 to rotate with the second belts 59. When paper of a print job is sent to the first paper transporting tray 51, the driving roller 55 transports the paper to the second paper transporting tray 53, and then the paper is sent to the corresponding paper tray 80 by the passive roller 57.

When a first print job is printed out and occupies one of the paper trays 80, and another print job is performed, the first driving device 3103 is run to drive the screw shaft 3101 to rotate along an axial direction. The nut 316 moves along the screw shaft 3101 and causes the second end 531 of the paper transporting module 50 to move along the row of the paper trays 80 from one to another, thereby adjusting the second end 531 of the paper transporting module 50 to rotate about the first pivot member 319 and the second pivot member 336 and simultaneously moving along the screw shaft 317, so that the apparatus transporting module 50 is connected to the next paper tray 80. Thus, the second print job may be transported to an empty paper tray 80. Accordingly, many print jobs can be sorted into different trays. During the movement, the second paper transporting tray 53 slides relative to the first paper transporting tray 51, so as to adjust a rotating radius of the paper transporting module 50 when the second end 531 moves along the screw shaft 317.

When the second end 531 of the paper transporting module 50 moves from an upper position or a lower position to a middle position, the rotating radius becomes smaller. Pressure applied on the two adjusting members 63 of each belt adjusting apparatus 60 is decreased. The actuating ends 655 of the spring members 65 expand out and drive the adjusting members 63 to move away from each other, to tighten the second belts 59 and cause the passive roller 57 to rotate as normal. When the second end 531 of the paper transporting module 50 is moved from a middle position to an upper position or a lower position, the rotating radius becomes greater. The moving process is converse to the above. The process repeats each time a print job comes through until all the paper trays 80 are used, and then starts with the first paper tray 80 again. Restarting the printer can set the process back to the first paper tray 80 again.

It is to be understood, however, that even though numerous characteristics and advantages of the embodiments have been set forth in the foregoing description, together with details of the structure and function of the present disclosure, the disclosure is illustrative only, and changes may be made in detail, especially in matters of shape, size, and arrangement of parts within the principles of the embodiments to the full extent indicated by the broad general meaning of the terms in which the appended claims are expressed.

What is claimed is:

1. A paper sorting apparatus for an electronic device, comprising:

a chassis with a control module disposed therein;

a paper transporting module accommodated in the chassis, the paper transporting module comprising a first transporting tray and a second transporting tray located on the first transporting tray, the first transporting tray pivotably attached to the chassis, the second transporting tray pivotably attached to the control module, and the first transporting tray slidable along the second transporting tray; and a plurality of paper trays attached to the chassis;

wherein the control module is capable of moving the second transporting tray to have one end of the second transporting tray approach one of the plurality of paper trays and rotating the first transporting tray by the second transporting tray; the control module comprises a screw shaft and a first driving device capable of driving the screw shaft; a movable member is coupled to the screw shaft, the movable member is connected to the second paper transporting tray of the paper transporting module, and the movable member and the second paper transporting tray are movable along the screw shaft; the first paper transporting tray comprises a first end, the second paper transporting tray comprises a second end, and a distance between the first end and the second end is inconstant when the movable member and the second paper transporting tray are moved along the screw shaft; a driving roller is located on the first paper transporting tray of the paper transporting module, the first paper transporting tray is rotatable relative to the driving roller, and a second driving device is connected to the driving roller; a passive roller is disposed at the second paper transporting tray of the paper transporting module, the second paper transporting tray is rotatable relative to the passive roller, the passive roller is connected to the driving roller by a belt, and the passive roller is rotatable together with the driving roller; a belt adjusting apparatus is positioned at the second paper transporting tray of the paper transporting module, the belt adjusting apparatus comprises two adjusting members disposed between the belt and two resilient members that respectively abut against the two adjusting members, and the two resilient members are capable of controlling the two adjusting members to move relative to each other.

2. The paper sorting apparatus of claim 1, wherein the passive roller comprises a wheel matched with the belt, and the wheel and the two adjusting members are arranged in a triangle shape.

3. The paper sorting apparatus of claim 1, wherein the two resilient members are torsion springs.

4. An electronic device, comprising:

a main body defining a paper outlet; and a paper sorting apparatus, the paper sorting apparatus comprising:

a chassis with a control module disposed therein;

a paper transporting module accommodated in the chassis, the paper transporting module having a first end corresponding to the paper outlet, and a second end attached to the control module; and a plurality of paper trays attached to the chassis, one of the plurality of paper trays corresponding to the second end;

wherein the control module is capable of rotating the first end and the second end, and a distance between the first end and the second end is inconstant when the first end and the second end are rotated; the control module comprises a screw shaft and a first driving device capable of rotating the screw shaft; a movable member is coupled to the screw shaft, and the movable member is connected to the second end of the paper transporting module and is capable of moving the second end; the second end is slidable relative to the first end to change the distance; a driving roller is disposed at the first end of the paper transporting module, and a second driving device is connected to the driving roller; a passive roller is disposed at the second end of the paper transporting module, and the passive roller is connected to the driving roller by a belt; a belt adjusting apparatus is positioned at the second end of the paper transporting module, the belt adjusting apparatus comprises two adjusting members disposed between the belt and two resilient members that respectively abut the two adjusting members, and the two resilient members are capable of controlling the two adjusting members to move relative to each other.

5. The electronic device of claim 4, wherein the passive roller comprises a wheel matched with the belt, and the wheel and the two adjusting members are arranged in a triangle shape.

6. The electronic device of claim 4, wherein the two resilient members are torsion springs.

* * * * *